US006520549B1

(12) United States Patent
Kalsi

(10) Patent No.: US 6,520,549 B1
(45) Date of Patent: Feb. 18, 2003

(54) VEHICLE DOOR LATCH

(75) Inventor: Gurbinder Singh Kalsi, Oldbury (GB)

(73) Assignee: Arvinmeritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/445,676

(22) PCT Filed: Jun. 18, 1998

(86) PCT No.: PCT/GB98/01788

§ 371 (c)(1),
(2), (4) Date: Mar. 6, 2000

(87) PCT Pub. No.: WO99/00571

PCT Pub. Date: Jan. 7, 1999

(30) Foreign Application Priority Data

Jun. 26, 1997 (GB) ..... 9713407

(51) Int. Cl.[7] ..... E05C 3/06; E05C 3/16

(52) U.S. Cl. ..... 292/216; 292/DIG. 23; 292/201

(58) Field of Search ..... 292/216, 201, 292/DIG. 23, DIG. 27

(56) References Cited

U.S. PATENT DOCUMENTS

| | | | | | |
|---|---|---|---|---|---|
| 3,695,662 | A | * | 10/1972 | Ploughman | 292/216 |
| 3,697,105 | A | * | 10/1972 | Marx | 292/216 |
| 4,492,395 | A | * | 1/1985 | Yamada | 292/216 |
| 5,137,311 | A | * | 8/1992 | Brackmann | 292/216 |
| 5,537,848 | A | * | 7/1996 | Grzanka et al. | 70/279 |
| 5,634,677 | A | * | 6/1997 | Buscher et al. | 292/216 |
| 5,921,595 | A | * | 7/1999 | Brackmann et al. | 292/216 |

FOREIGN PATENT DOCUMENTS

| | | |
|---|---|---|
| EP | 0106725 | 4/1984 |
| EP | 0336034 | 10/1989 |
| GB | 2108191 | 5/1983 |
| GB | 2270111 | 3/1994 |

* cited by examiner

*Primary Examiner*—Anthony Knight
*Assistant Examiner*—John B. Walsh
(74) *Attorney, Agent, or Firm*—Wood, Phillips, Katz, Clark & Mortimer

(57) ABSTRACT

A vehicle door latch assembly including a pivotally mounted latch claw having a mouth operatively co-acting with a striker as the door nears its closed position, a latching pawl self-engaging with the claw to hold it in latched condition retaining the door, and an unlatching mechanism selectively operable to disengage the latching pawl for opening the door. The unlatching mechanism includes a pawl lifter movable from a position of rest to carry the latching pawl out of engagement with the claw, a power output lever movable to engage and displace the pawl lifter from said position of rest, an input crank power actuated between first and second positions, a clutch releasably drive connecting the input crank to the output lever to cause shifting of the latter as the input crank moves to its second position, and an overriding link carrying the clutch into and out of drive connection. The overriding link is operatively coupled to a manually operable release link of the door to ensure that manual operation of the pawl lifter is not obstructed by failure or malfunction of power actuation of the input crank.

12 Claims, 2 Drawing Sheets

VEHICLE DOOR LATCH

Figure 1:
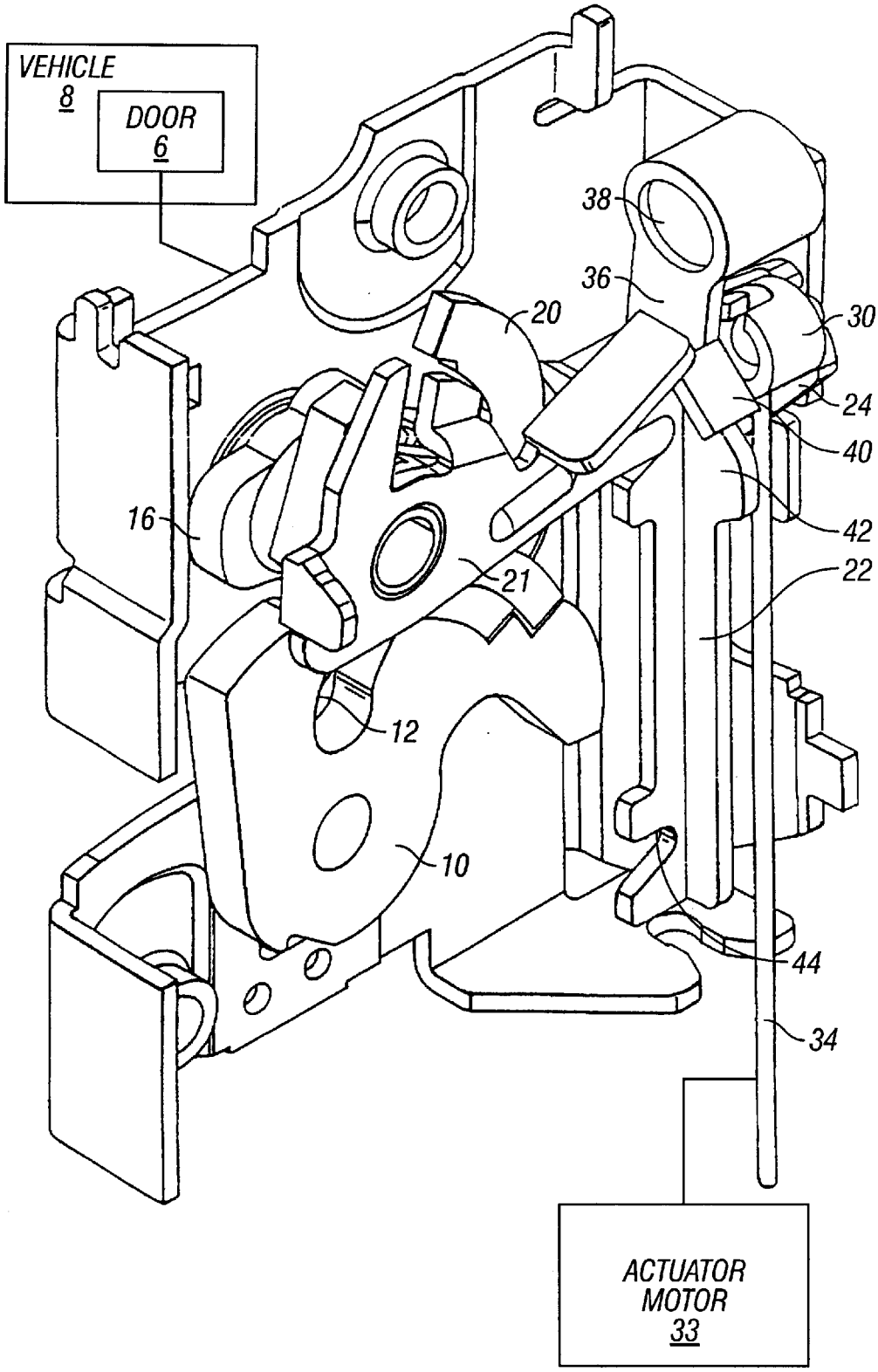

This invention relates to latches for vehicle doors, particularly for light passenger and goods vehicles.

Powered locking and powered latching of doors is becoming more favoured, both as part of central locking systems, and to enable more effective weathersealing of doors and greater freedom in styling and design. There are also advantages in providing for power actuated unlatching of doors in terms of dispensing with much of the mechanical linkage and components needed for conventional manual inside and outside door handles, and in providing unitary lock and latch modules of standard form which can be speedily insalled in doors of a wide range of vehicle models and types without special adaptation.

An example of the provision of power closing is described and claimed in our co-pending patent application GB 9710602.5 dated May 23rd 1997, and the present invention may conveniently be combined with that construction if desired.

The object of the invention is to provide improvements in vehicle door latch assemblies, in particular the provision of latches having a power unlatching facility in an economical, effective and reliable form.

According to the invention there is provided a vehicle door latch assembly including a pivotally mounted latch claw having a mouth operatively co-acting with a striker as the door nears its closed position, a latching pawl self-engaging with the claw to hold it in latched condition retaining the door, and unlatching means selectively operable to disengage the latching pawl for opening the door: characterised in that the unlatching means comprises a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the latter as the input member moves to its second position, and an overriding element carrying the clutch means into and out of drive connection, said overriding element being operatively coupled to manually operable release means of the door to ensure that manual operation of the pawl lifter is not obstructed by failure or malfunction of power actuation of the input member.

The output member is conveniently a power release lever having an arm positioned for engagement with the pawl lifter and a second arm provided with a drive formation forming a first element of the clutch means.

The input member may be a crank element coupled to an electric or other power actuator for angular movement and carrying a drive formation forming a second element of the clutch means, the pivot of the crank element being carried on the overriding element which is shifted on manual operation of the release means to move the crank element in a direction disengaging said drive formations of the clutch means.

Figure 2:
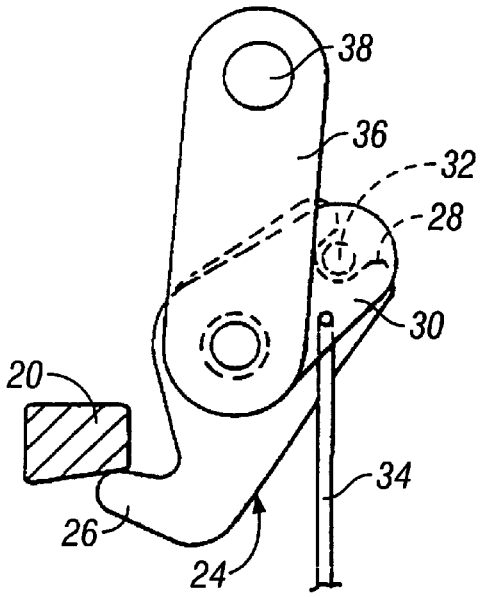
Figure 3:
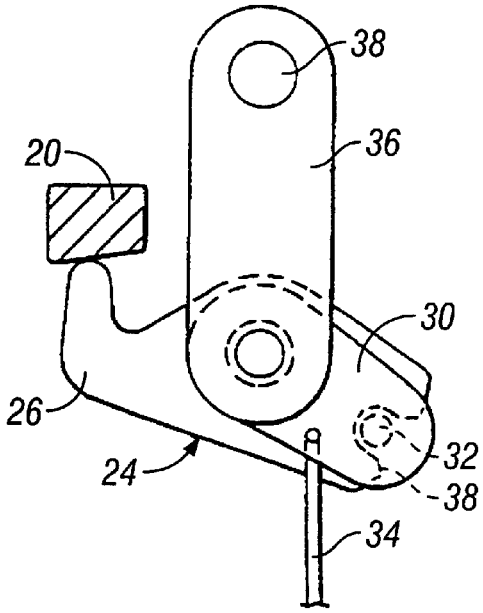
Figure 4:
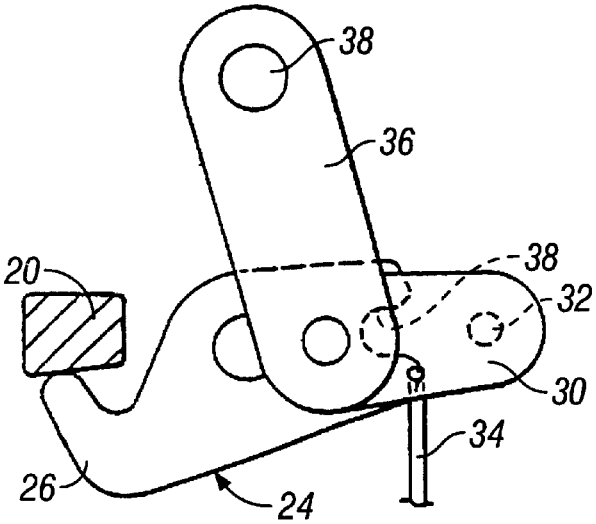

An example of the invention is now more particularly described with reference to the accompanying drawings in which:

FIG. 1 is a perspective view of a vehicle door latch assembly with some parts not relevant to the invention removed for clarity, FIG. 2 is a diagram of power unlatching parts of said assembly in an engaged rest position, FIG. 3 is a like diagram with the parts in a power unlatched position, and FIG. 4 is a like diagram with the parts in a declutched manual override position.

Referring firstly to FIG. 1, the latch assembly, which will be operatively secured in a door 6 on a vehicle 8 in known manner, includes a conventional rotating latch claw 20 having a mouth 12 for coacting with a striker (not shown) operatively mounted to the associated door post. A latching pawl 16 self-engages with the claw in known manner to retain it and hence the door 6, releasably at a first safety position at which the door is near closed, and an inner position shown in the drawing at which the door is fully shut.

The assembly may include powered closing/latching of the door as described in our said co-pending patent application.

Unlatching means includes a pawl lifter 20 in the form of a two armed lever pivoted co-axially with pawl 16 which engages the latter when angularly displaced form its position of rest shown in the drawing, so causing disengagement of pawl 16 from claw 10 to free the door for opening. Manually operable release means includes a manual release lever 21, also pivoted co-axially with pawl 16 alongside lifter 20. Lever 21 is coupled to lifter 20 for movement of the latter when a lock link (not shown) is in unlocked condition. A manual release member of the door (not shown) e.g. a door handle, is coupled to lever 21 through a vertical longitudinally displaceable link 22 having connection at its upper end with the right-hand arm of that lever.

An output member in the form of a power release lever 24, best seen in FIGS. 2–4, is fulcrummed on a fixed pivot whose axis is in a plane normal to the claw axis. Its left-hand arm 26 is positioned to engage the lower face of a rightward extension of pawl lifter 20 so that when it is turned clockwise it displaces lifter 20 and so causes disengagement of pawl 16 independently of lever 21. The right hand arm of lever 24 terminates in a drive formation in the form of a notch 28 opening away from the lever axis.

An input member in the form of a crank 30 extending alongside said righthand arm has a drive pin 32 which, in the position shown in FIGS. 1–3, is engaged in notch 28 so that angular movement of crank 30 is transmitted to lever 24. An electric actuator motor 33 is coupled to crank 30 by a vertical power drive link 34, selectively operable to power crank 30.

Crank 30 is pivoted on the lower end of a swinging overriding element 36, the upper end of which is mounted on a fixed pivot 38 in spaced parallel relationship to the axis of release lever 24. In the angular position shown in FIGS. 1–3 the pivot axes of crank 30 and lever 24 are substantially co-incident, so maintaining the clutch means constituted by notch 28 and pin 32 in drive engagement.

The lower end of element 36 includes a camming formation 40 (FIG. 1) which co-acts with an upwardly tapering ramp 42 on the upper end of the vertical link 22. If there should be any malfunction of the power unlatching actuator or associated parts e.g. due to a flat battery, which might block the latching/unlatching functions operation of the manually operable release means will result in upward movement of link 22, causing ramp 42 to push formation 40 to the right. This displaces crank 30 longitudinally in relation to release lever 24 so declutching pin 32 from notch 28 and freeing the latter lever so that it cannot interfere with actuation of pawl lifter 20 by means of manual release lever 21.

A spring (not shown) on overriding element 36 provides a restoring force urging re-engagement of pin 32 in notch 28 when power actuation is restored or reset.

A notch 44 at the lower end of link 22 may be utilised to operate disabling means of the power closing mechanism of the assembly, if this is included, as described in our said co-pending application. Thus manual operation is ensured regardless of any failure or malfunction of either power closing or power unlatching.

What is claimed is:

1. A vehicle door latch assembly comprising a pivotally mounted latch claw having a mouth operatively co-acting with a striker as a door on which the vehicle door latch assembly is secured nears its closed position, a latching pawl self-engaging with the claw to hold it in latched condition retaining a door on which the vehicle door latch assembly is secured, and unlatching means selectively operable to disengage the latching pawl to allow opening of a door on which the vehicle door latch assembly is secured, wherein the unlatching means comprises a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the latter as the input member moves to its second position, an overriding element carrying the clutch means into and out of drive connection, said overriding element being operatively coupled to manually operable release means to ensure that manual operation of the pawl lifter is not obstructed by failure or malfunction of power actuation of the input member, said vehicle door latch assembly further comprising an actuator motor for moving the power output member.

2. A vehicle door latch comprising a pivotally mounted latch claw having a mouth operatively co-acting with a striker as a door on which the vehicle door latch assembly is secured nears its closed position, a latching pawl self-engaging with the claw to hold it in latched condition retaining a door on which the vehicle door latch assembly is secured, and unlatching means selectively operable to disengage the latching pawl to allow opening of a door on which the vehicle door latch assembly is secured, wherein the unlatching means comprises a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the latter as the input member moves to its second position, and an overriding element carrying the clutch means into and out of drive connection, said overriding element being operatively coupled to manually operable release means to ensure that manual operation of the pawl lifter is not obstructed by failure or malfunction of power actuation of the input member, wherein the power output member is a release lever mounted by a first pivot, a first arm positioned for engagement with the pawl lifter and a second arm provided with a drive formation forming an overriding element is in the form of a link mounted by a third pivot.

3. A latch assembly comprising a pivotally mounted latch claw having a mouth operatively co-acting with a striker as a door on which the vehicle door latch is secured nears its closed position, a latching pawl self-engaging with the claw to hold it in latched condition retaining a door on which the vehicle door latch is secured, and unlatching means selectively operable to disengage the latching pawl to allow opening of a door on which the vehicle door latch assembly is secured, wherein the unlatching means comprises a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the latter as the input member moves to its second position, and an overriding element carrying the clutch means into and out of drive connection, said overriding element being operatively coupled to manually operable release means to ensure that manual operation of the pawl lifter is not obstructed by failure or malfunction of power actuation of the input member, wherein the power input member is a power driven crank element mounted by a second pivot and having an arm provided with a drive formation forming an element of the clutch means.

4. A latch assembly as defined in claim 3 or 1 characterised in that the release lever has a second arm and the second arm of the release lever and said arm of the crank element are in generally face to face relationship, their distal end parts being provided with the coacting drive formations of the clutch means.

5. A latch assembly as in claim 4 characterised in that one of said drive formations is a pin and the other of said formations is a notch.

6. A latch assembly as in claim 5 characterised in that the second pivot is displaceable to shift the crank element from a position where the notch and pin are engaged to a position where they are disengaged.

7. A latch assembly as in claim 6 characterised in that the second pivot is mounted on the overriding element.

8. A latch assembly as in claim 7 characterised in that the overriding element is in the form of a link mounted by a third pivot.

9. A latch assembly as defined in claim 8 characterised in that the overriding element is operatively acted on by the manually operable release means through a camming formation on at least one of the overriding element or that portion of the manually operable release means contacted by the overriding element.

10. A latch assembly comprising a pivotally mounted latch claw having a mouth operatively co-acting with a striker as a door on which the vehicle door latch assembly is secured nears its closed position, a latching pawl self-engaging with the claw to hold it in latched condition retaining a door on which the vehicle door latch is secured, and unlatching means selectively operable to disengage the latching pawl to allow opening of a door on which the vehicle door latch assembly is secured, wherein the unlatching means comprises a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the latter as the input member moves to its second position, and an overriding element carrying the clutch means into and out of drive connection, said overriding element being operatively coupled to manually operable release means to ensure that manual operation of the pawl lifter is not obstructed by failure or malfunction of power actuation of the input member, wherein the overriding element is resiliently biased to the position at which the clutch means is engaged.

11. A latch assembly as defined in claim 2 characterised in that the power input member is a power driven crank element mounted by a second pivot and having an arm provided with a drive formation forming an element of the clutch means.

12. A vehicle including a latch assembly as defined in any one of claims 2, 3, 10, 11 or 1.

* * * * *